US008096862B1

(12) United States Patent
Demster

(10) Patent No.: US 8,096,862 B1
(45) Date of Patent: Jan. 17, 2012

(54) ISOLATION DAMPER WITH PROOFING

(76) Inventor: Stanley J. Demster, Lenexa, KS (US)

( * ) Notice: Subject to any disclaimer, the term of this patent is extended or adjusted under 35 U.S.C. 154(b) by 1066 days.

(21) Appl. No.: 11/938,032

(22) Filed: Nov. 9, 2007

Related U.S. Application Data

(60) Provisional application No. 60/865,125, filed on Nov. 9, 2006.

(51) Int. Cl.

| | |
|---|---|
| ***F24F 13/10*** | (2006.01) |
| ***F24F 11/00*** | (2006.01) |
| ***B01L 1/02*** | (2006.01) |
| *F24F 11/10* | (2006.01) |

(52) U.S. Cl. ..... 454/237; 454/238; 454/187

(58) Field of Classification Search ..... 454/237, 454/238, 239, 240, 187; 114/312, 314, 317, 114/334, 335

See application file for complete search history.

(56) References Cited

U.S. PATENT DOCUMENTS

| | | | | |
|---|---|---|---|---|
| 3,561,387 | A * | 2/1971 | Kumm et al. | 114/322 |
| 3,623,443 | A * | 11/1971 | Luther | 114/314 |
| 4,196,656 | A * | 4/1980 | Wallace et al. | 454/70 |
| 4,299,066 | A * | 11/1981 | Thompson | 52/81.6 |
| 4,428,529 | A * | 1/1984 | Bentsen | 236/49.4 |
| 4,669,413 | A * | 6/1987 | Cummins | 114/335 |
| 4,694,768 | A * | 9/1987 | Aloisio | 114/71 |
| 5,538,471 | A * | 7/1996 | Guiles, Jr. | 454/238 |
| 5,545,086 | A * | 8/1996 | Sharp et al. | 454/238 |
| 6,186,891 | B1 * | 2/2001 | D'Andrea | 454/187 |
| 6,805,623 | B2 * | 10/2004 | Robison et al. | 454/143 |
| 7,118,474 | B2 * | 10/2006 | Bjordal | 454/238 |
| 2003/0109963 | A1 | 6/2003 | Oppedisano et al. | |
| 2004/0200398 | A1 * | 10/2004 | Goesmann et al. | 114/335 |

OTHER PUBLICATIONS

M&I Air Systems Engineering, M&I Air—Products Page listings hhtp://www.miair.com/show_products2.php?Id=5 showing Commercial Grade Positive Steel Dampers: Believed to be on sale more than one year prior to the earliest filing date of this application.

* cited by examiner

*Primary Examiner* — Steven B McAllister
*Assistant Examiner* — Frances H Kamps
(74) *Attorney, Agent, or Firm* — Erickson, Kernell, Derusseau & Kleypas, LLC

(57) ABSTRACT

An isolation damper for preventing the migration of air from a ventilated space includes a high differential pressure sealing chamber in the damper assembly that prevents the flow of air from the "clean" side of the damper assembly to the "dirty" side thereof. Pressurized air leaking out of the sealing chamber creates reverse flow leakage toward the dirty side which assures the clean side air is not contaminated by the dirty side air. Differential pressure between the sealing chamber and the dirty side is monitored with the differential pressure reported and alarmed externally if reductions in pressure indicate the sealing effect of the sealing chamber could be affected.

7 Claims, 1 Drawing Sheet

ISOLATION DAMPER WITH PROOFING

CROSS-REFERENCE TO RELATED APPLICATION

This application claims the benefit of a prior filed, application Ser. No. 60/865,125, filed on Nov. 9, 2006 entitled ISOLATION DAMPER WITH PROOFING.

FIELD OF THE INVENTION

The present invention relates to dampers for air delivery ducts and, more particularly, to a damper for an air duct that provides a means to isolate or seal off an air delivery duct to prevent leakage of contaminated air from an isolated containment area.

BACKGROUND OF THE INVENTION

Air dampers which provide low leakage are known in the art. In certain applications, a room, area or facility may require the ability to be isolated relative to the ventilation system of the building to contain chemical, biological or radiological hazards. Research laboratories, pharmaceutical production areas and chemical plants are examples where isolation is important. It is also important to provide adequate air ventilation to these facilities. If a hazardous material is spilled it becomes necessary to isolate the area of the spill. Air dampers with mechanical seals may be closed to help contain the air borne hazardous materials. However, over time the seals may become dirty or worn and lose their effectiveness, or the dampers may be damaged, bent, or obstructed by a foreign object preventing the dampers from fully closing. Further, failure of an air damper to provide the necessary isolation when required likely would only be discovered after a hazardous material is released.

SUMMARY OF THE INVENTION

The damper assembly of the present invention does not rely on mechanical seals exclusively to provide the isolating function as is common in the industry. Leakage prevented by creating a high differential pressure sealing chamber in the damper assembly that prevents the flow of air from the "clean" side of the damper assembly to the "dirty" or "contaminated" side thereof. Pressurized air leaking out of the sealing chamber creates reverse flow leakage toward the dirty side which assures the clean side air is not contaminated by the dirty side air. Furthermore, the pressure in the sealing chamber is monitored with the differential pressure reported and alarmed externally if reductions in pressure indicate the sealing effect of the sealing chamber could be affected. By measuring the differential pressure from the sealing chamber to the dirty side of the damper it is possible to determine the quality and effectiveness of the damper in providing absolute isolation.

DETAILED DESCRIPTION

Figure 1:
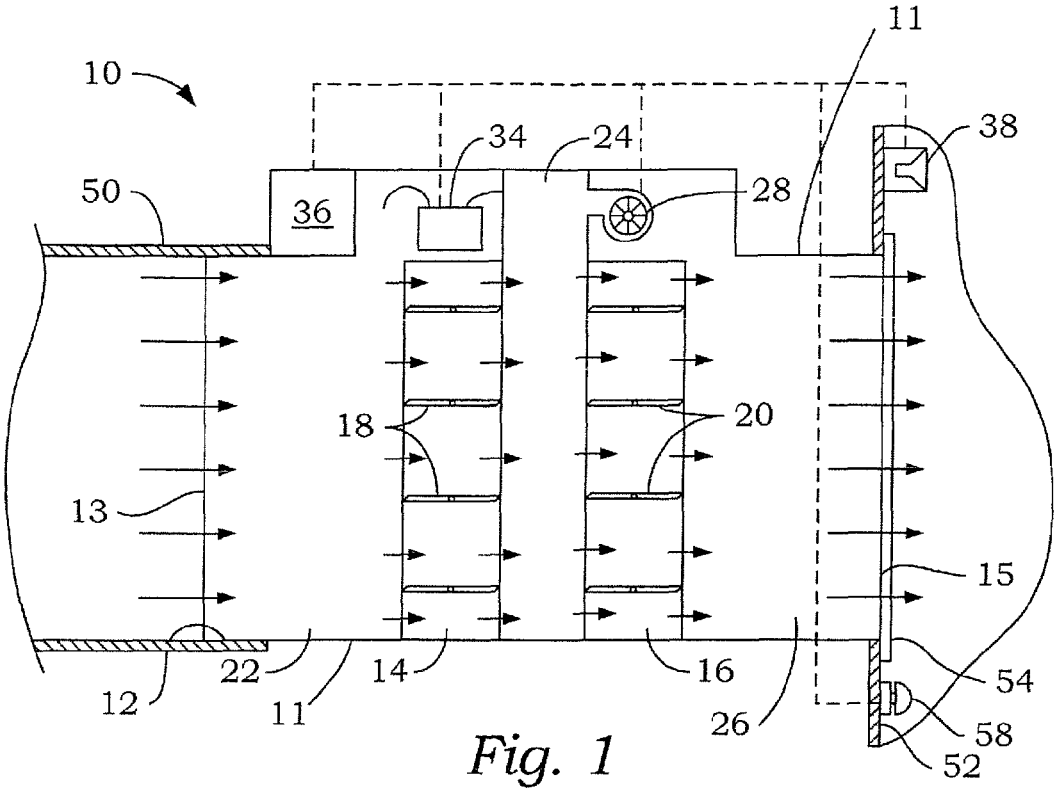
FIG. 1 is a diagrammatic plan view of an isolation damper of the present invention shown with the dampers open.

The preferred embodiment of the isolation damper assembly 10 of the present invention is shown in FIG. 1. The isolation damper assembly 10 includes a housing 11 with an interior chamber or passageway 12 with an inlet 13 and outlet 15. The housing is divided into three sections by low leakage primary and secondary dampers 14 and 16 mounted therein. The dampers 14 and 16 shown are blade-type dampers having a of plurality blades 18 and 20, respectively, moved between open and closed alignment by a damper motor, not shown. The primary and secondary dampers 14 and 16 divide the housing 11 into a first or contaminated air chamber 22, a second or high pressure sealing chamber 24, and a third or clean air chamber 26. A fan or blower 28 is mounted within the damper housing 11 to pull clean air from the clean air chamber 26 and blow it into the high pressure chamber 24.

As shown in FIG. 1, the damper 10 and primary damper 14 may be used for conventional modulation of airflow without the need to activate the blower 28 or close the secondary damper 16. This feature reduces the wear on the secondary damper 16 and the blower 28. Only in isolation mode does the blower 28 energize and close the secondary damper 16.

The primary and secondary dampers 14 and 16 may be of various geometries including, rectangular, round or square. They can be single blade or multi-blade opposed or parallel blade dampers. Sliding gate dampers may also be used. Virtually any damper style and construction will work in this design so long as the leakage produced by the closed damper is substantially lower than the blower 28 flow rating to create higher pressure in the chamber 24 than in chamber 22.

Figure 2:
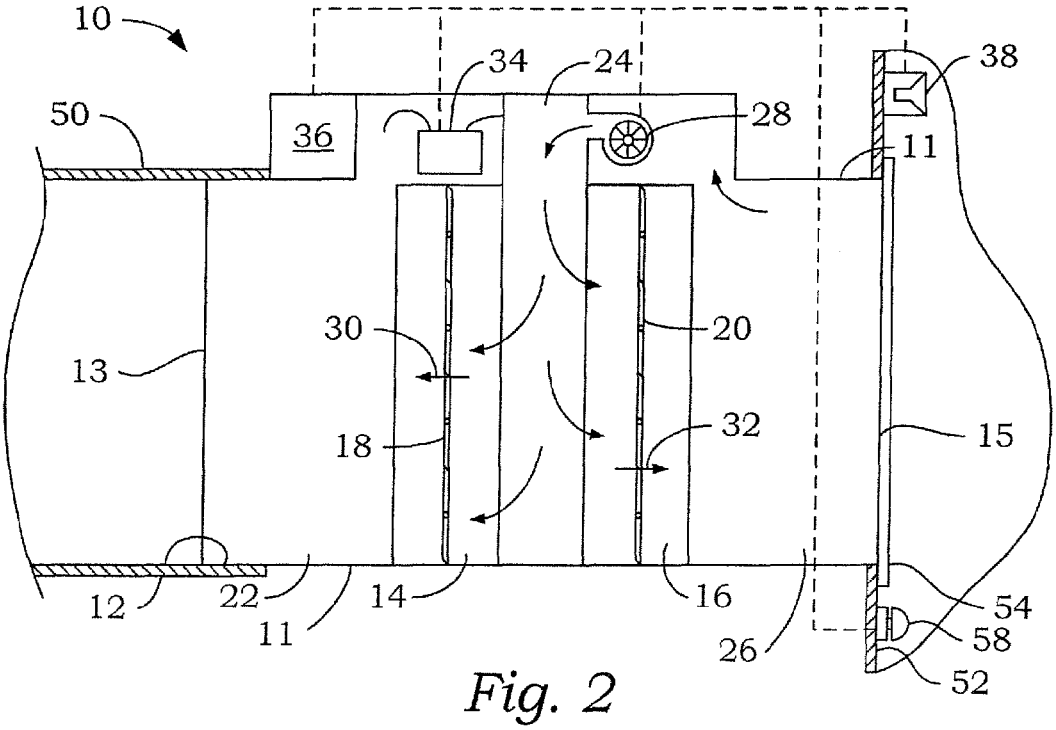
FIG. 2 is the isolation damper of FIG. 1 shown with the dampers closed.

Referring to FIG. 2, running the blower 28 when the primary and secondary dampers 14 and 16 are closed creates a zone of high pressure in chamber 24 relative to chambers 22 and 26. To the extent the blades 18 and 20 of the dampers 14 and 16, respectively, do not form a perfect seal when closed, pressurized air from chamber 24 will flow or migrate outward into the adjacent chamber 22 or 26 as indicated by flow arrows 30 and 32, respectively. The reverse air flow 32 into chamber 22 prevents contaminated air from chamber 22 and the adjacent room from flowing past the high pressure sealing chamber 24.

A differential pressure sensor 34 that measures the pressure differential between chamber 22 and chamber 24 is mounted within the housing 11 and communicates the measured pressure differential or the measured pressure in each of the chambers 22 and 24 or both to a processor or controller 36. The controller 36 receives and processes the information from the pressure sensor 34 to operate and communicate the functions of the damper 10 and signal if the pressure differential between chambers 24 and 22 drops to an unacceptable level. The sensor 34 includes a microcontroller device that converts the differential pressure signal into a value that allows determination of satisfactory operation. By reporting the differential pressure, it is possible to determine the relative condition of the damper 10. Declining differential pressure would indicate a need to service the unit before it loses effectiveness. If the measured differential pressure drops to or below a set point stored in the controller 36, the controller 36 would cause an alarm 38 to activate. Similarly the controller 36 could cause an alarm to activate if the rate of decline of differential pressure exceeds a preprogrammed set point or if there is a total loss of differential pressure. By continuous and integral monitoring of the pressure differential, the damper 10 provides positive assurance as to the effectiveness of the device unlike conventional dampers that have no means of providing this invaluable information.

It is foreseen that instead of measuring the pressure differential, the damper could include an instrument to simply measure the pressure in the high pressure chamber 24 and compare that pressure versus a pressure set point. If the pressure drops below the pressure set point when the primary and secondary dampers are closed, the processor would activate the external alarm indicating the risk of failure of the seal.

Specific design parameters like size of the blower and leakage of the dampers are readily determined by persons skilled in the art of HVAC product design. Dependability of the device in the field would require a skilled tradesman to install the damper in a manner that assures it seals with the duct and a source of standby power to assure the device is operational if the power fails.

In applications that demand specific damper performance under conditions like fire and smoke, existing dampers rated for such an application may be used within this device to preclude the need to develop a new damper design. This allows relatively low cost components that are readily available to now function as an absolute seal against unwanted airflow.

In the embodiment shown, the isolation damper 10 is mounted within or in line with an air delivery duct 50 which delivers conditioned air to a room 52. A grate 54 is shown covering the outlet 15 of the isolation damper 10. In a typical installation one damper 10 will be mounted in each duct supplying air to and receiving return air from the room or area which is to be selectively isolated. It is foreseen that if multiple ducts supplying air to or returning air from a room branch off of a single trunk line, a damper 10 could be mounted in the trunk line instead of each separate supply or return duct.

An activation mechanism, such as a button 58 is mounted within the room 52 in communication with the controller 36. Pressing the button 58 sends a signal to the controller 36 to activate the isolation feature. More specifically, the controller controls the operation of the damper motors to shut the dampers 14 and 16, activates the blower 28 and takes readings from the differential pressure sensor 34. The system would also include a reset feature, which might simply comprise pressing the button 58 a second time to cause the controller 36 to open the dampers 14 and 16, turn-off the blower 28 and cease taking readings from the pressure differential sensor 34. It is also to be understood that the controller 36 may communicate with a thermostat (not shown) in the room 52 to control the degree to which the primary damper 14 is opened in a non-isolation mode to control the flow of conditioned air thereto.

It is to be understood that while certain forms of this invention have been illustrated and described, it is not limited thereto, except in so far as such limitations are included in the following claims and allowable equivalents thereof.

Having thus described the invention, what is claimed as new and desired to be secured by Letters Patent is:

1. An isolation damper comprising:

a housing having an interior chamber, an inlet and an outlet, a primary damper mounted in said housing proximate said inlet, movable between an open position and a closed position, a secondary damper mounted in said housing proximate said outlet and spaced apart from said primary damper, movable between an open position and a closed position, said primary damper and said secondary damper dividing said interior chamber of said housing into first, second and third chambers, wherein said first chamber extends between said inlet and said primary damper, said second chamber extends between said primary damper and said secondary damper and said third chamber extends between said secondary damper and said outlet, and a blower having an inlet in communication with said third chamber and an outlet in communication with said second chamber, said blower being energized to blow air into said second chamber only when said secondary damper is in said closed position.

2. The isolation damper as set forth in claim 1 wherein said blower is energized to blow air into said second chamber at a pressure which exceeds the pressure of the air in the first and third chambers.

3. The isolation damper as set forth in claim 1 further comprising a differential pressure sensor in communication with said first chamber to measure a first air pressure therein and said second chamber to measure a second air pressure therein, said differential pressure sensor generating a differential pressure output signal indicative of the pressure differential between said first and second air pressures measured in said first and second chambers, respectively.

4. The isolation damper as set forth in claim 3 further comprising a controller in communication with said differential pressure sensor and an alarm; said controller programmed to compare a value of said differential pressure output signal to a differential pressure set point and activate said alarm if the value of said differential pressure output signal is less than or equal to said differential pressure set point.

5. An isolation damper comprising:

a housing having an inlet and an outlet, said housing extending from a first area to a second area, a primary damper mounted in said housing proximate said inlet, movable between an open position and a closed position to regulate the flow of air passing from said inlet to said outlet, a secondary damper mounted in said housing proximate said outlet spaced apart from said primary damper to present a sealable chamber therebetween, said secondary damper movable between an open position and a closed position, a blower having an inlet in communication with said second area and an outlet in communication with said sealable chamber, said blower energized in response to said secondary damper moving to said closed position, and a differential pressure sensor having a first air pressure input port in communication with said first area to measure a first air pressure therein and a second air pressure input port in communication with said sealable chamber to measure a second air pressure therein, said differential pressure sensor generating a pressure differential output signal indicative of the difference between said first air pressure and said second air pressure, said differential pressure sensor energized in association with said secondary damper moving to said closed position.

6. The isolation damper as set forth in claim 5 wherein said blower is energized to blow air into said second chamber at a pressure which exceeds the pressure of the air in the first and second areas.

7. The isolation damper as set forth in claim 5 further comprising a controller in communication with said differential pressure sensor and an alarm; said controller programmed to compare a value of said differential pressure output signal to a differential pressure set point and activate said alarm if the value of said differential pressure output signal is less than or equal to said differential pressure set point.

* * * * *